US007021919B2

(12) United States Patent
Griffith

(10) Patent No.: US 7,021,919 B2
(45) Date of Patent: Apr. 4, 2006

(54) APPARATUS FOR FORMING CONCRETE BLOCKS OR STONES WITH A ROUGH SURFACE

(76) Inventor: Tom Griffith, 53 Holgate Street, Barrie, Ontario (CA), L4N 2T8

( * ) Notice: Subject to any disclaimer, the term of this patent is extended or adjusted under 35 U.S.C. 154(b) by 401 days.

(21) Appl. No.: 10/307,785

(22) Filed: Dec. 2, 2002

(65) Prior Publication Data

US 2004/0104511 A1 Jun. 3, 2004

(51) Int. Cl.

| | |
|---|---|
| ***B28B 7/06*** | (2006.01) |
| ***B28B 7/10*** | (2006.01) |
| ***B28B 11/08*** | (2006.01) |
| ***B29C 59/02*** | (2006.01) |

(52) U.S. Cl. ..... 425/308; 425/289; 425/412; 425/422; 425/444; 249/112; 249/117; 249/140; 264/162; 264/163

(58) Field of Classification Search ..... 425/289, 425/308, 412, 422, 444; 249/112, 117, 140; 264/162, 163

See application file for complete search history.

(56) References Cited

U.S. PATENT DOCUMENTS

| | | | | | |
|---|---|---|---|---|---|
| 433,785 | A | | 8/1890 | Harding | |
| 1,471,990 | A | * | 10/1923 | Wert | 264/163 |
| 3,245,648 | A | * | 4/1966 | Johansson et al. | 249/33 |
| 3,247,299 | A | * | 4/1966 | Zaha | 264/158 |
| 3,679,340 | A | * | 7/1972 | Springs | 425/163 |
| 3,940,229 | A | * | 2/1976 | Hutton | 425/436 R |
| 3,974,996 | A | * | 8/1976 | Violet | 249/112 |
| 3,981,953 | A | * | 9/1976 | Haines | 264/163 |
| 4,271,111 | A | | 6/1981 | Sheber | |
| 4,869,660 | A | | 9/1989 | Ruckstuhl | |
| 5,078,940 | A | | 1/1992 | Sayles | |
| 5,088,686 | A | | 2/1992 | Soofi | |
| 5,217,630 | A | * | 6/1993 | Sayles | 249/52 |
| 5,879,603 | A | * | 3/1999 | Sievert | 264/163 |
| 6,113,379 | A | | 9/2000 | LaCroix et al. | |
| 6,138,983 | A | * | 10/2000 | Sievert | 249/114.1 |
| 6,209,848 | B1 | | 4/2001 | Bolles et al. | |
| 6,224,815 | B1 | * | 5/2001 | LaCroix et al. | 264/333 |
| 6,464,199 | B1 | * | 10/2002 | Johnson | 249/117 |
| 2003/0164574 | A1 | * | 9/2003 | Hammer et al. | 264/162 |

* cited by examiner

*Primary Examiner*—Michael P. Colaianni
*Assistant Examiner*—Michael I. Poe
(74) *Attorney, Agent, or Firm*—Hodgson Russ LLP

(57) ABSTRACT

A mold for forming blocks with at least one textured surface, the mold comprising a structure defining a cavity open at opposite ends thereof for receiving a block forming material at one of the open ends and discharging a block formed from the block forming material at the other of the open ends; and a continuous web surrounding at least a portion of the structure and movable relative to the structure for acting on the block forming material received within the cavity to impart a texture to a surface of the block, the web being mounted to move around the portion of the structure when the block is discharged from the cavity.

14 Claims, 4 Drawing Sheets

APPARATUS FOR FORMING CONCRETE BLOCKS OR STONES WITH A ROUGH SURFACE

BACKGROUND OF THE INVENTION

This invention relates to a method and apparatus for forming blocks and is particularly concerned with the formation of concrete blocks with a rough surface resembling that of a split face block or having a textured or irregularly smooth surface.

In the manufacture of concrete blocks, blocks are typically formed by the compression of concrete mix in a mold using a combination of pressure and vibration. In a typical manufacturing process, molds are open at the top and bottom and have a retractable bottom plate. Concrete mix is introduced into the mold cavity from the top of the mold and compressed by means of a plate which descends into the mold and forms the top surface of the mold cavity. These plates are typically hydraulically activated and referred to as "stripper shoe plates" or "shoe plates". Vibration of the mold during compression is used to hasten the compaction and formation of the block. After a brief period of compression, a block is stripped from the mold. During stripping, the mold is raised while the shoe plate holds the block in position on the bottom plate. After the mold has been raised, the shoe plate is raised and the block is released. According to other known processes, rather than raising the mold, the bottom plate is retracted and the shoe plate applies a downward pressure pushing the block though the open bottom of the mold. Both of the described processes render a block with smooth vertical sides. In many applications it is more esthetically desirable to have a block with a rough or irregularly smooth surface.

One method of forming blocks with a rough surface is to form one large block and split it into two small pieces after the concrete has cured. This process renders a product known as split face block. While the appearance of a split face block is preferable to that of a smooth face block in some applications, the splitting process is time consuming and increases the cost of producing blocks for several reasons including the creation of substantial waste material.

A known alternative for forming blocks with a rough surface is to use a mold cavity with projections, protrusions or other obstructions attached to the interior of the mold such that the block is torn, scraped or smeared as the block is stripped from the mold. An example of such a process can be seen in U.S. Pat. No. 5,217,630, issued Jun. 8, 1993. Various styles of projections, protrusions and other obstructions are known in the block forming art. Some known processes also include a lower wall or lip which extends inwardly from the mold wall whereon the projections are attached. Other known processes also include a reinforcing mesh screen in front of the projections. These methods may be cheaper than manually producing a split face block, but produce a block which is generally less esthetically desirable. In addition, the projections, protrusions or other obstructions attached to the interior of the mold may clog with concrete mix, requiring frequent cleaning and resultant down time for machinery.

Another known alternative, an example of which can be seen in U.S. Pat. No. 6,224,815, issued May 1, 2001, uses a mold with two cavities divided by a vertically-oriented member comprising a grate. The action of stripping the blocks from the mold is used to create a roughened surface on the grate side of the blocks.

Another known alternative, an example of which can be seen in U.S. Pat. No. 3,981,953, issued Sep. 21, 1976, is to use a mold with one or more grooved surfaces on the interior of the mold which are at an angle to the direction in which the mold is stripped. Some known processes use wall projections and protrusions in addition to the grooved surfaces.

Another known alternative embeds a frame or pattern within the concrete mix during compaction. The frame is then moved upwards or otherwise relative to the concrete mass such that the portion of the concrete mix above the frame is retained on or about the frame, randomly fracturing the surface of the block.

Another known alternative uses a mold with opposed, inwardly extending upper and lower lips along at least one of the sidewalls of the mold. The upper lip is located at about the determined height of the composite fill level within the mold cavity, and the lower lip is located at the bottom of the mold cavity. During operation, a metal pallet is placed under the mold. Composite material is filled from the open top. The action of stripping the blocks from the mold creates a roughened surface on the lip side or sides of the block. When the blocks are stripped from the mold, the lower lip acts to strip fill retained between the lips of the mold away from the remainder of the block that will become the roughened surface. Another known process uses a mold that has only a lower lip with grooves oriented at an angle to the direction that blocks are stripped from the mold.

In addition to the random, broken appearance of a split face block, it is also desirable to create blocks with an irregular but smooth surface that imitates natural quarried stone. Like the appearance of a split face block, a block with an irregularly smooth appearance can be more esthetically desirable in some applications than that of a smooth face block. A known method for forming a block with an irregularly smooth surface is to use a mold having an interiorly textured mold sidewall that is retractable by means of hydraulic cylinders or otherwise. Concrete mix is introduced into the mold cavity from its open top. The mix is then compacted using a shoe plate, and vibrated to form a concrete block. The textured cavity wall is then retracted away from the block, and the mold is raised while the shoe plate holds the block in place. The shoe plate is then raised to release the block.

A common drawback of many of the previously used methods that attempt to simulate split face blocks or textured face blocks, is that they produce blocks which all have an identical or substantially similar face, rather than the uniquely random look that results in manually split blocks or textured blocks. Additionally, many of the known methods for mass producing split face and textured face blocks employ costly equipment or costly methods.

Thus, there is a need for a device and method for forming split face and textured face blocks that have non-identical faces. Such a device and method that can be cost effectively employed in high volume production is also needed.

SUMMARY OF THE INVENTION

The present invention overcomes some of the foregoing problems in the prior art by providing a method and apparatus for forming blocks with a rough, textured or irregularly smooth surface that does not require the use of projections, protrusions or other obstructions rigidly attached to the interior of the mold and without using grooved surfaces on the mold walls.

In accordance with one aspect of the present invention there is provided a mold for forming blocks with at least one textured surface, the mold including a structure defining a cavity open at opposite ends thereof for receiving a block forming material at one of the open ends and discharging a block formed from the block forming material at the other of the open ends. A continuous web surrounds at least a portion of the structure and is movable relative to the structure for acting on the block forming material received within the cavity to impart a texture to a surface of the block, the web being mounted to move around the portion of the structure when the block is discharged from the cavity.

In accordance with another aspect of the present invention there is provided an apparatus for forming blocks with at least one textured surface, including a structure defining a cavity open at a top and bottom thereof to allow block forming material to be introduced into the cavity through the open top and to discharge molded block forming material in the form of a molded block through the open bottom, a support member cooperating with the structure to form a closed bottom for the cavity to allow the block forming material introduced into the cavity to be temporarily retained within the cavity, a continuous web which surrounds at least a portion of the structure, and movable relative to the structure, for imparting a texture to at least a portion of a surface of the molded block, and a stripping shoe for acting on the molded block through the open cavity top when relative vertical separation motion occurs between the structure and the support member to discharge the molded block from the cavity.

In accordance with another aspect of the present invention there is provided a method of forming blocks with at least one textured surface, including the steps of: (a) introducing block forming material into a mold, the mold having a structure defining a cavity open at opposite receiving and discharge ends thereof for receiving a block forming material at the receiving end and discharging a block formed from the block forming material at the discharge end, and a web within the cavity and movable relative to the structure; (b) compacting the block forming material within the cavity such that at least a portion of the web is embedded in the block forming material; and (c) discharging the block formed from the block forming material such that the web moves through the cavity with the block, and separating the web from the block at the discharge end of the structure.

BRIEF DESCRIPTION OF THE DRAWINGS

The present invention will be further understood from reference to the following drawings in which.

Similar references are used in different figures to denote similar components.

DETAILED DESCRIPTION OF THE INVENTION

Figure 1:
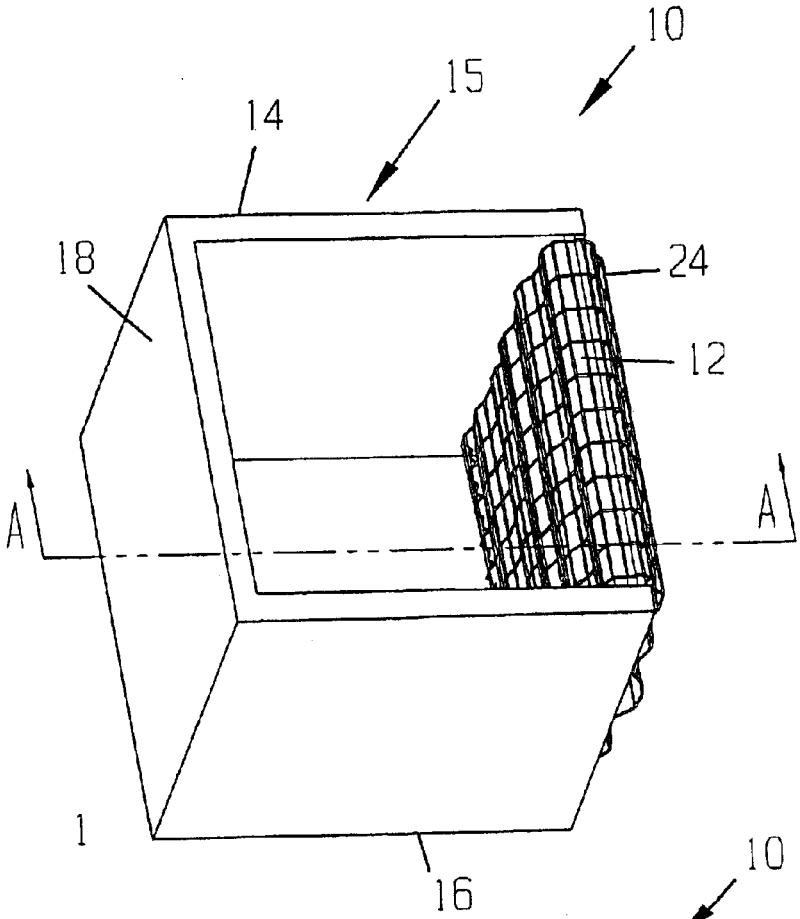
FIG. 1 illustrates a perspective view of one embodiment of a block forming apparatus constructed according to the present invention.
Figure 2:
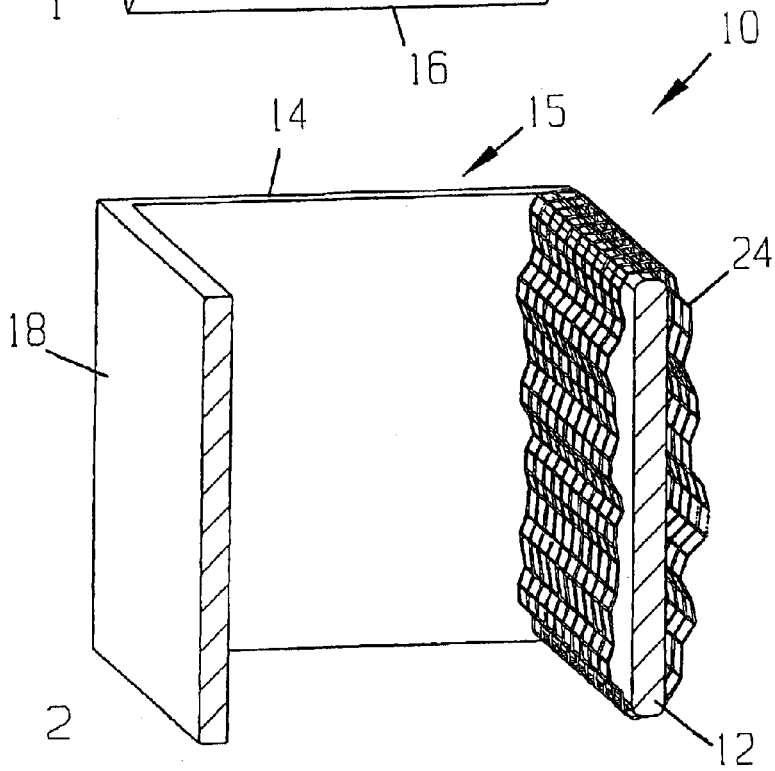
FIG. 2 illustrates a sectional perspective view of the embodiment of FIG. 1 taken generally along line A—A.
Figure 3:
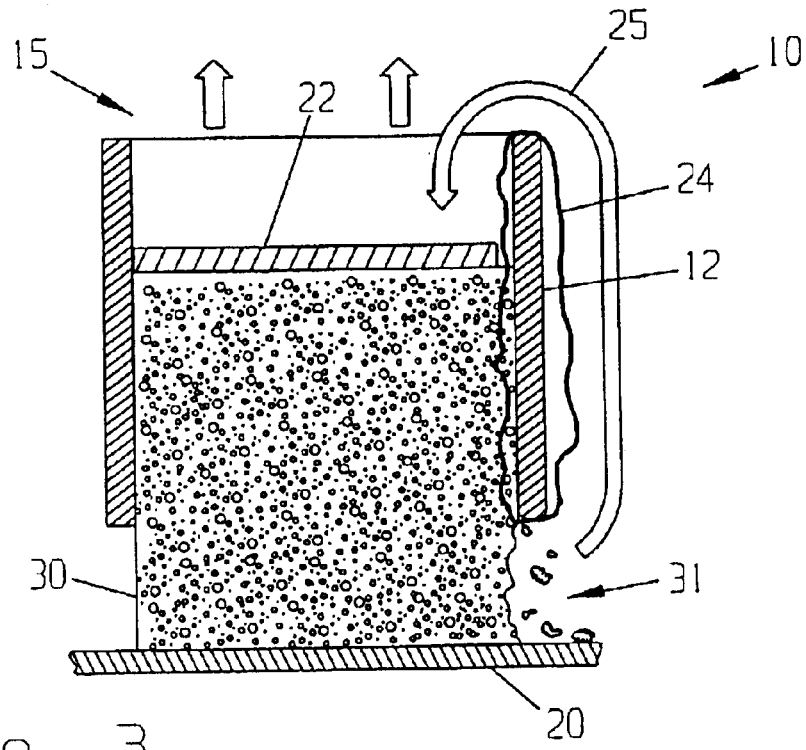
FIG. 3 illustrates a sectional view of the block forming apparatus of FIG. 1 with block forming material received therein, showing the operation of the apparatus.

Referring now to FIGS. 1, 2 and 3, a block forming apparatus in accordance with one embodiment of the present invention is indicated generally at 10. The block forming apparatus 10 comprises a mold 15 having sidewalls 12, 14, 16 and 18, and is open at its top and bottom. The apparatus 10 also includes a continuous web, which in the present embodiment is a wire mesh 24 which surrounds sidewall 12 such that it is constrained horizontally by sidewalls 14 and 16, but is free to move vertically. The side walls 12, 14, 16 and 18 form a cavity into which block forming material 30 is introduced. The material 30 may be a standard mix which is known in the block forming art and comprises an aggregate material, cement and water. It may also include other ingredients, such as pigments, plasticizers, and other filling materials, depending on the application.

Projections can be attached to or incorporated in the wire mesh 24 to increase the roughness and random unevenness of surface created by the mesh 24. The mesh 24 may be fabricated of a fine wire or cable. In one embodiment, loops of cable are attached to or incorporated in the wire mesh 24 so as to increase the roughness and random unevenness of surface of the mesh 24 facing the interior of mold cavity. It is to be understood that the mesh may be constructed of other materials, and that other forms of projections, protuberances or obstructions can be attached to or incorporated in the mesh 24. For example, steel or rubber studs 28 such as those shown in FIG. 5 could be integrated into the mesh 24 for acting on the block forming material.

As seen in FIG. 3, the block forming apparatus 10 also includes a shoe plate 22. The shoe plate 22 conforms to the size and shape of the mold cavity, and is sized to allow a predetermined clearance between with the sidewalls 12, 14, 16 and 18. The clearance is set to allow the shoe plate 22 to move downwardly through the mold cavity as the mold 15 is stripped, but does not allow block forming material 30 to move upwards past the shoe plate 22 during stripping.

Referring now to FIG. 3, the formation of a concrete block by the block forming apparatus 10 will be described. The mold 15 is lowered on to a pallet 20, with the bottom edges of sidewalls 12, 14, 16, 18 resting on, or just slightly spaced above the pallet 20. The pallet 20 may be comprised of a rigid material such as wood, plastic or metal. Prior to the insertion of the shoe plate 22 into the mold cavity, block forming material 30 is introduced into the cavity of the mold 15 from its open top to a predetermined fill level within the mold 15. The mold 15, pallet 20, or a combination of both, may then be vibrated for a desired period of time to hasten the filling and setting of block forming material 30 in the mold 15. The shoe plate 22 is then lowered into the mold cavity and used to exert a downward pressure to compact the material 30 within the mold 15. The mold 15, pallet 20, or a combination of both, may be vibrated to hasten the compaction of the block forming material 30. During filling and compaction, the wire mesh 24 becomes incorporated within the block forming material 30.

After the material has been compacted for a suitable period of time, a block is stripped from the mold 15. The mold 15 is raised off the pallet 20 while the shoe plate 22 holds the block forming material 30 in position on the pallet 20. As the mold 15 is raised off the pallet 20, the wire mesh 24 is pulled downwardly through the mold cavity by the block forming material 30 and rotates about a sidewall 12 as indicated by arrow 25. At the lower end of sidewall 12, the wire mesh 24 is pulled out of the block forming material 30 whereby a portion of the material 30 is retained on the surface of the mesh 24. As the mesh 24 negotiates the lower end of sidewall 12, the material retained on the surface of the mesh 24, being inflexible, breaks away and falls as scrap 31.

The action of stripping the block from the mold 15 creates a roughened surface on the side of the block opposite the wire mesh 24. The time spent filling the mold, vibration time, compaction time and level of fill within the mold depends on the particular machinery used and the particular application.

When the mold 15 has been raised so as to clear the upper surface of the block formed, the pallet 20 is removed so that the block can be transported to an area where it will be cured and hardened in accordance with known practices in the block forming art. Air curing, autoclaving, steam curing and mist curing are known practices which can be used to cure the block formed by the invention.

The self-cleaning action of the block forming apparatus 10 may be supplemented by standard cleaning brushes known in the block forming art. Between cycles of use of the apparatus 10, sweeping brushes can be used to sweep the top and bottom of the mold 15, cleaning the portions of mesh 24 at the top and bottom of the mold 15 at the same time. As the mesh 24 rotates with each cycle, the mesh 24 would be swept in its entirety within several cycles.

It is to be understood that a mold having more or less than four sidewalls could be used, and that the mesh could be constrained by other means than two of the mold sidewalls, without departing from the scope of the invention. The wire mesh may also be constrained by ledges, setbacks, grooves or other structures, if constructed appropriately, so that the mesh is constrained horizontally but is free to move vertically with the mold cavity without interfering the stripping or movement of the block through the mold. Moreover, if it is desired to have a block with only a portion of one of its surfaces roughened, the mesh may be constructed and associated with the mold so as to span only a portion of a mold sidewall.

With the construction and operation of the block forming apparatus described above, it is possible to form blocks having a roughened surface similar to that of split face blocks without using a mold having projections, protuberances or obstructions rigidly attached to the interior of the mold. This reduces the frequency and length of mold cleaning required and resultant downtime for machinery, resulting in lower costs of manufacture for blocks having a split face appearance. Additionally, the rotating mesh can introduce a degree of randomness into the block forming process, providing blocks having a variety of different split face finishes, thereby more closely simulating manually split blocks. In apparatus 10, the wire mesh 24 is sufficiently slack that it is embedded at a varying depth along the height of the block, increasing the randomness of the resulting textured face.

Figure 4:
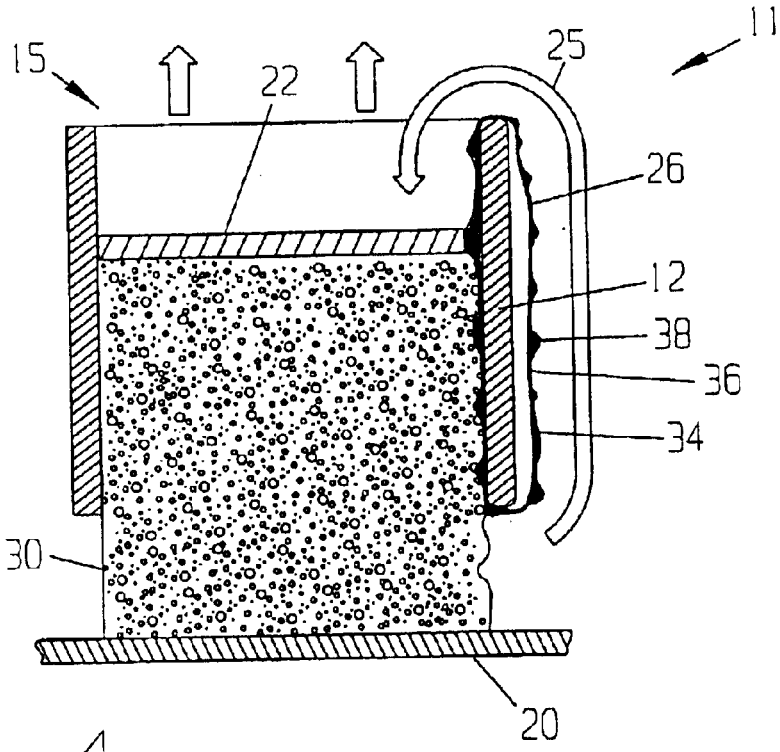
FIG. 4 illustrates a sectional view of a second embodiment of a block forming apparatus constructed according to the present invention with block forming material received therein, showing the operation of the apparatus.

Referring now to FIG. 4, a block forming apparatus in accordance with another embodiment of the present invention is indicated generally at 11. The block forming apparatus 11 is substantially similar in construction and operation to apparatus 10, except that the continuous web has a different configuration. The block forming apparatus 11 comprises a mold 15 having sidewalls 12, 14, 16 and 18, and is open at its top and bottom. The apparatus 11 also includes a continuous belt 26, which surrounds sidewall 12 such that it is constrained horizontally by sidewalls 14 and 16, but is free to move vertically. The side walls 12, 14, 16 and 18 form a cavity into which block forming material 30 is introduced.

Figure 5:
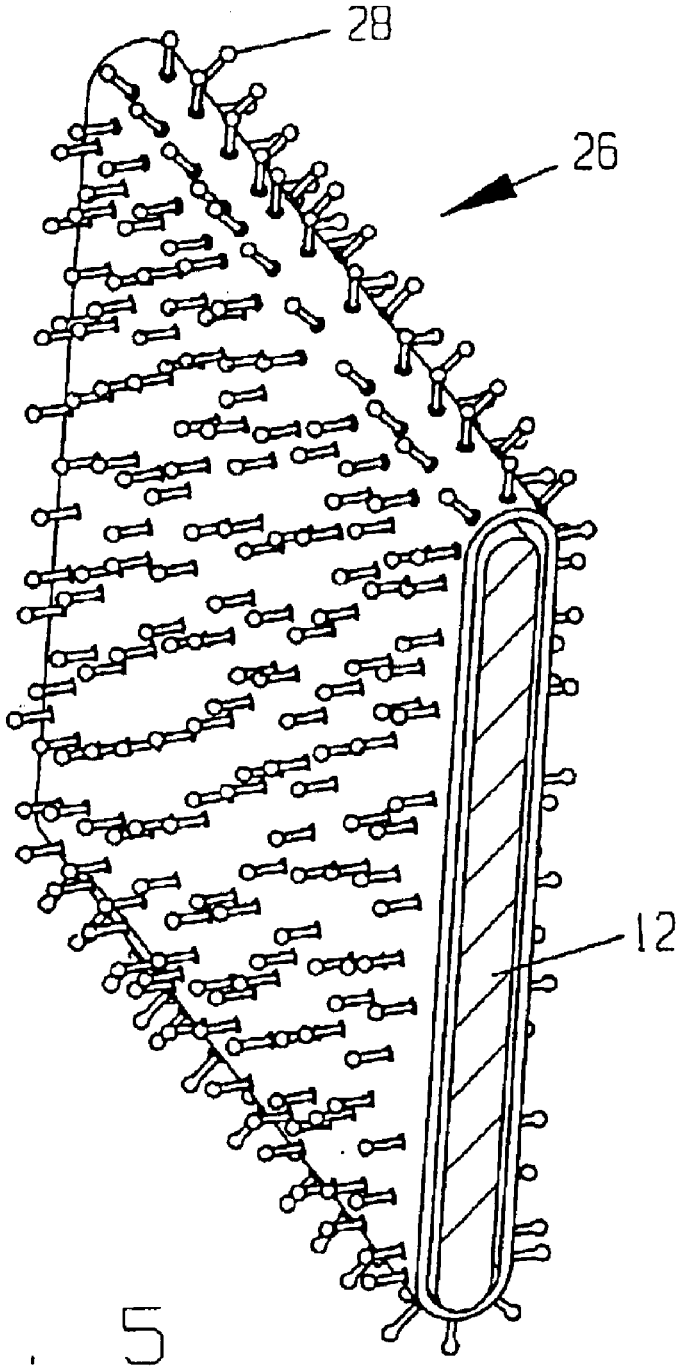
FIG. 5 illustrates a sectional view of one embodiment of a web for use in a block forming apparatus according to the present invention.

The belt 26 is comprised of a flexible, durable material such as steel-reinforced rubber or plastic. Projections, protuberances or obstructions are formed into or attached to the surface of the belt 26 to increase the roughness and random unevenness of the surface of the belt 26 facing the interior of the mold 15. The belt 26 may have bulges, bumps, groves or ridges on its surface, or may have metal, plastic or rubber studs attached to its surface. For example, in FIG. 4, randomly spaced bumps 34, grooves 36, and ridges 38 are located on belt 26. The projections may be of varying sizes and varying spacing. Referring now to FIG. 5, a further exemplary belt 26 includes steel-reinforced rubber with a plurality of rubber studs 28 attached to its surface. It is to be understood that the belt may be comprised of other flexible, durable materials, and that other forms of projections, protuberances and obstructions can be attached to or incorporated in the belt 26.

The block forming apparatus 11 also includes a shoe plate 22. The shoe plate 22 conforms to the size and shape of the mold cavity, and is sized to allow a predetermined clearance between with the sidewalls 12, 14, 16 and 18. The clearance is set to allow the shoe plate 22 to move downwardly through the mold cavity as the mold 15 is stripped, but does not allow block forming material 30 to move upwards past the shoe plate 22 during stripping.

Referring now to FIG. 4, the formation of a concrete block by the block forming apparatus 11 will be described. The mold 15 is lowered on to a pallet 20, with the bottom edges of sidewalls 12, 14, 16, 18 resting on, or just slightly spaced above the pallet 20. Prior to the insertion of the shoe plate 22 into the mold cavity, block forming material 30 is introduced into the cavity of the mold 15 from its open top to a predetermined fill level within the mold 15. The mold 15, pallet 20, or a combination of both, may then be vibrated for a desired period of time to hasten the filling and settling of the block forming material 30 in the mold 15. The shoe plate 22 is then lowered into the mold cavity and used to exert a downward pressure to compact the material 30 within the mold 15. The mold 15, pallet 20, or a combination of both, may be vibrated to hasten the compaction of the block forming material 30.

After the material has been compacted for a suitable period of time, a block is stripped from the mold 15. The mold 15 is raised off the pallet 20 while the shoe plate 22 holds the block forming material 30 in position on the pallet 20. As the mold 15 is raised off the pallet 20, the belt 26 is pulled downwardly through the mold cavity by the block forming material 30 and rotates about a sidewall 12 as indicated by arrow 25. At the lower end of sidewall 12, the belt 26 is pulled out of the block forming material 30 without any substantial removal of block forming material 30.

The presence of the belt 26 within the mold cavity during compaction acts to imprint a texture on the surface of the block opposite the belt 26. The texture imprinted on the surface of the block corresponds to the particular projections, protuberances or obstructions attached to or incorporated in the belt 26. By changing the particular projections, protuberances or obstructions that are attached to or incorporated in to the belt 26 the textured imprinted on the surface of the block may be changed. The time spent filling the mold, vibration time, compaction time and level of fill within the mold depends on the particular machinery used and the particular application.

When the mold 15 has been raised so as to clear the upper surface of the block formed, the pallet 20 is removed so that the block can be transported to an area where it will be cured and hardened in accordance with known practices in the block forming art. Air curing, autoclaving, steam curing and mist curing are known practices which can be used to cure the block formed by the invention.

The self-cleaning action of the block forming apparatus 11 may be supplemented by standard cleaning brushes known in the block forming art. Between cycles of use of the apparatus 11, sweeping brushes can be used to sweep the top and bottom of the mold 15, cleaning the portions of the belt 26 at the top and bottom of the mold 15 at the same time. As the belt 26 rotates with each cycle, the belt 26 would be swept in its entirety within several cycles.

As with apparatus 10, it is to be understood that with apparatus 11 a mold having more or less than four sidewalls could be used, and that the belt could be constrained by other means than two of the mold sidewalls, without departing from the scope of the invention. The belt may also be constrained by ledges, setbacks or grooves, if constructed appropriately, so that the belt is constrained horizontally but is free to move vertically with the mold cavity without interfering the stripping or movement of the block through the mold. Moreover, if it is desired to have a block with only a portion of one of its surfaces roughened, the belt may be constructed and associated with the mold so as to span only a portion of a mold sidewall.

With the construction and operation of the block forming apparatus 11 described above, it is possible to form blocks having a textured or irregularly smooth surface without using a mold having one or more textured retractable sidewalls. This reduces the complexity of the mold required and the production time for each block, resulting in lower costs of manufacture for blocks having a textured or irregularly smooth surface. Additionally, the use of a continuous, rotating belt can introduce a degree of randomness so as a result in varied block face surfaces. The presence of the projections of varying size and relative spacing on the web can further enhance variations in the texture.

Figure 6:
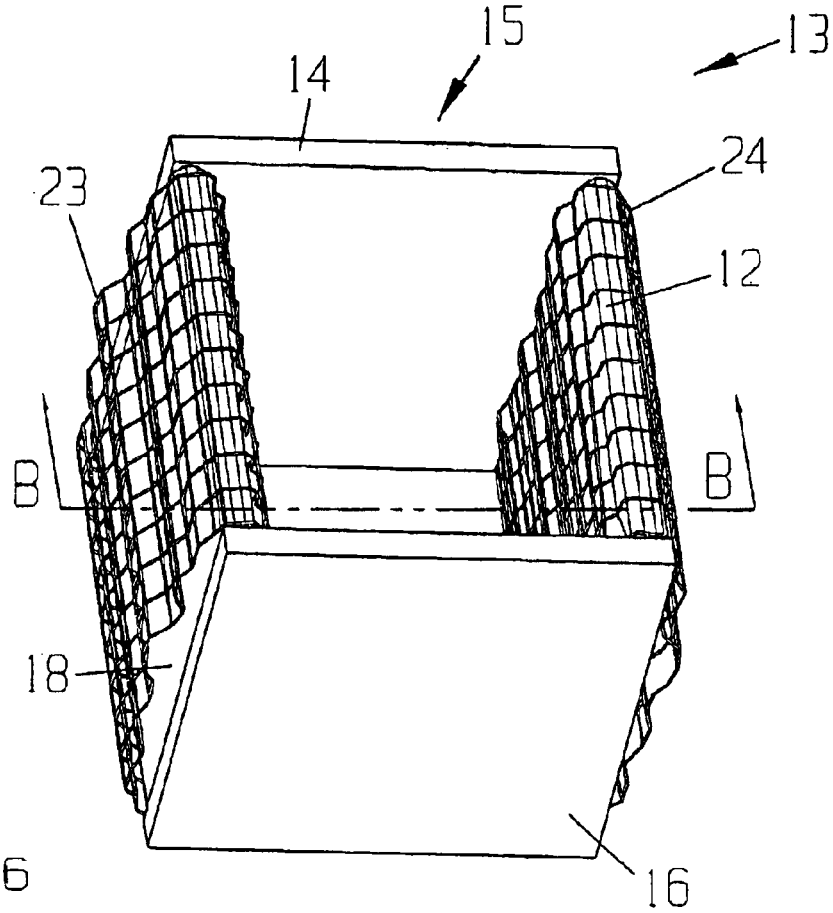
FIG. 6 illustrates a perspective view of another embodiment of a block forming apparatus constructed according to the present invention.
Figure 7:
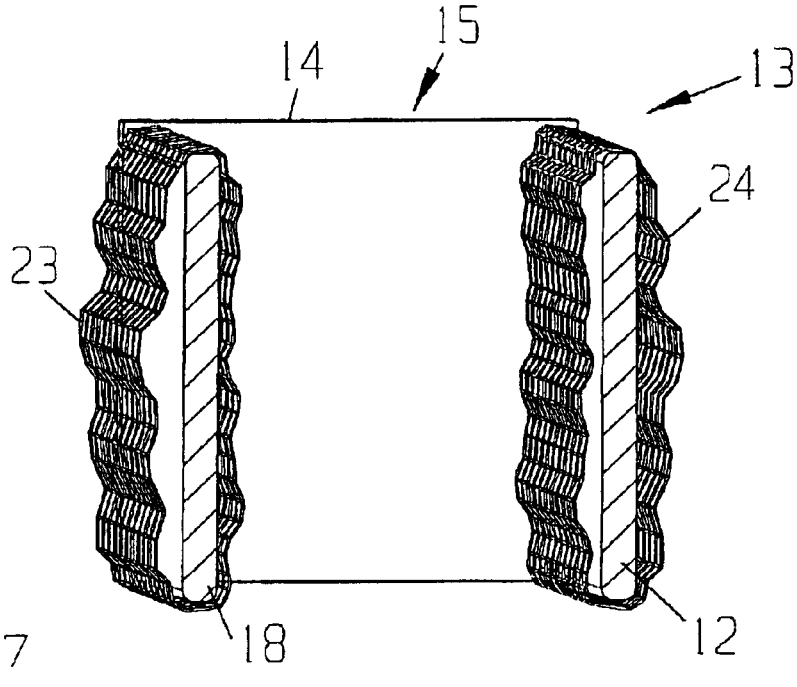
FIG. 7 illustrates a sectional perspective view of the embodiment of FIG. 6 taken generally along line B—B.

Referring now to FIGS. 6 and 7, a block forming apparatus in accordance with another embodiment of the present invention is indicated generally at 13. The block forming apparatus 13 comprises a mold 15 having sidewalls 12, 14, 16 and 18, and is open at its top and bottom. The apparatus 13 also includes two continuous webs, which in the present embodiment is a wire mesh 24 which surrounds sidewall 12 such that it is constrained horizontally by sidewalls 14 and 16, but is free to move vertically, and a wire mesh 23 which surrounds sidewall 18 such that it is constrained horizontally by sidewalls 14 and 16, but is free to move vertically. The side walls 12, 14, 16 and 18 form a cavity into which block forming material 30 is introduced.

Numerous modifications, various, alternatives and adaptations may be made to the particular embodiments described above without departing from the scope of the invention which is defined in the claims.

What is claimed is:

1. A mold for forming blocks with at least one textured surface, the mold comprising:

a structure defining a cavity open at opposite ends thereof for receiving a block forming material at one of the open ends and discharging a block formed from the block forming material at the other of the open ends; and a continuous web surrounding at least a portion of the structure and movable relative to the structure for acting on the block forming material received within the cavity to impart a texture to a surface of the block, the web being mounted to move around the portion of the structure when the block is discharged from the cavity.

2. The mold of claim 1 wherein the continuous web includes a flexible mesh screen.

3. The mold of claim 1 wherein the open opposite ends are at a top and bottom of the structure and the web is mounted for substantially vertical movement.

4. The mold of claim 2 wherein the structure includes a plurality of side walls, the web surrounding at least a portion of one of the side walls and being constrained from horizontal movement.

5. The mold of claim 1 wherein the continuous web includes a flexible belt having an outer facing surface with a plurality of projections for acting on the block forming material.

6. The mold of claim 5 wherein the projections have varying sizes and the spacing between adjacent projections varies over the surface of the belt.

7. The mold of claim 5 wherein the projections include studs mounted to the flexible belt.

8. The mold of claim 5 wherein the flexible belt is formed from reinforced rubber.

9. An apparatus for forming blocks with at least one textured surface, comprising:

a structure defining a cavity open at a top and bottom thereof to allow block forming material to be introduced into the cavity through the open top and to discharge molded block forming material in the form of a molded block through the open bottom;

a support member cooperating with the structure to form a closed bottom for the cavity to allow the block forming material introduced into the cavity to be temporarily retained within the cavity;

a continuous web which surrounds at least a portion of the structure, and movable relative to the structure, for imparting a texture to at least a portion of a surface of the molded block; and a stripping shoe for acting on the molded block through the open cavity top when relative vertical separation motion occurs between the structure and the support member to discharge the molded block from the cavity.

10. The apparatus of claim 9 wherein the structure has a plurality of side walls, the web surrounding at least a portion of one of the side walls for substantially vertical movement relative to the one side wall.

11. The apparatus of claim 10 further comprising a plurality of continuous webs each surrounding and movable relative to a respective side wall for imparting texture to a plurality of surfaces of the molded block.

12. The apparatus of claim 10 wherein the web is constructed of a flexible mesh screen, the web forming a rough and randomly uneven surface opposite to the one side wall.

13. The apparatus of claim 10 wherein projections of varying size and varying relative spacing are provided on an outer surface of the web for acting on the block forming material.

14. The apparatus of claim 10 wherein the web is constructed of a flexible rubber belt having a plurality of projections provided on an outer surface thereof.

* * * * *